US005083969A

United States Patent [19]

Wagener

[11] Patent Number: 5,083,969

[45] Date of Patent: Jan. 28, 1992

[54] HINGE AND MOUNTING OF A TOY CAR'S DOOR

[75] Inventor: Claus Wagener, Dietenhofen, Fed. Rep. of Germany

[73] Assignee: Fritz Wagener GmbH, Dietenhofen, Fed. Rep. of Germany

[21] Appl. No.: 632,356

[22] Filed: Dec. 21, 1990

[30] Foreign Application Priority Data

Dec. 22, 1989 [DE] Fed. Rep. of Germany ..... 3942522

[51] Int. Cl.[5] ..... A63H 17/26; A63H 17/00; A63H 33/04

[52] U.S. Cl. ..... 446/470; 446/95; 446/87

[58] Field of Search ..... 446/470, 471, 87, 93, 446/94, 95, 102, 110

[56] References Cited

U.S. PATENT DOCUMENTS 4,655,727 4/1987 Swisher et al. ..... 446/470

FOREIGN PATENT DOCUMENTS 1922880 11/1969 Fed. Rep. of Germany ..... 446/470
2503752 8/1976 Fed. Rep. of Germany ..... 446/470
2720641 11/1977 Fed. Rep. of Germany ..... 446/95
694818 9/1965 Italy ..... 446/470

*Primary Examiner*—D. Neal Muir
*Attorney, Agent, or Firm*—Toren, McGeady & Associates

[57] ABSTRACT

In a model vehicle having a door assembly attached by a pivot bearing to a body including a door sill delimiting a doorway, it is desirable that the pivot bearing should be situated within the doorway permit easy installation and combine simple construction with strength to withstand rough usage. This object is achieved in that a metallic pivot pin attached to a door sill within the doorway projects with its free end upwardly from the door sill and in that a bearing cavity receiving the pivot pin is formed by the door assembly itself. The pivot bearing provided is of simple construction, easy to install and capable of withstanding stresses other than caused by normal opening and closing of the door.

6 Claims, 1 Drawing Sheet

FIG.1
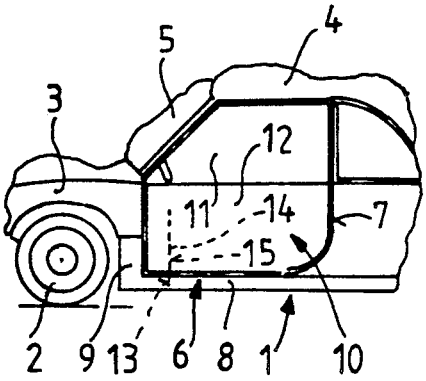
FIG.2
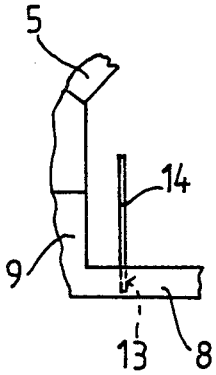
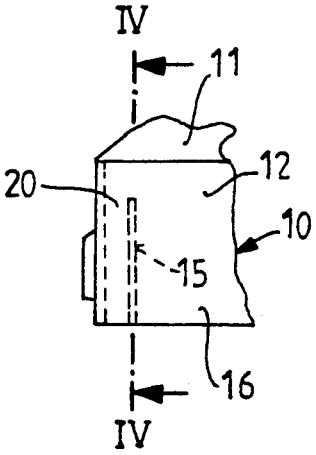
FIG.3
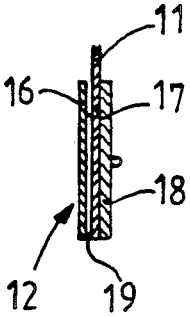
FIG.4
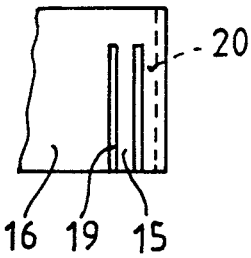
FIG.5

HINGE AND MOUNTING OF A TOY CAR'S DOOR

BACKGROUND OF THE INVENTION

The invention relates to a model vehicle with a side door wherein a door assembly made of plastic material is hinged by means of a vertical pivot bearing to a body made of plastic material, said body having a door sill delimiting a doorway and a front jamb delimiting the doorway.

A model vehicle should look as authentic as possible, also in the region of the side doors. On opening, a side door should turn out of, but not swing out entirely from, the doorway which calls for locating the turning axis within the doorway. The pivot bearing should be easy to install and of rugged construction.

SUMMARY OF THE INVENTION

It is an object of the invention to provide a model vehicle of the type initially referred to wherein the pivot bearing is located within the doorway, is easy to install and, combines simplicity with rugged construction to withstand rough usage. In achieving this object, the model vehicle according to the invention is characterized in that an oblong metallic pivot pin located on the door sill within the doorway close to the front jamb projects with its free end upwardly from the door sill and a bearing cavity receiving the pivot pin is formed by the door assembly itself.

The door assembly is easy to slide with the bearing cavity onto the well visible pivot pin which, owing to its length, provides exact guidance and support of the door assembly. Since the pivot centre is within the doorway, the door assembly on opening does not swing out entirely from the doorway.

The proposed pivot bearing is of simple construction, easy to install and capable of withstanding stresses other than caused by normal opening and closing of the door. There is no need for fine, snap-fit hinge parts. Since the horizontal cross-section of the roof region of the model vehicle is narrower than the width of the body at the level of the door sill, the door assembly can be conveniently slid onto the upwardly projecting pivot pin.

It is specially desirable and advantageous if the distance between the bearing cavity and the outer surface of the door assembly is substantially smaller than the distance between the bearing cavity and the inner surface of the door assembly. With this configuration, the front end of the door assembly on opening will clear the front door jamb of the body more freely in an improved manner.

It is also specially desirable and advantageous if, with the door assembly swung out 90°, there is a gap between the outer surface of the door assembly and the front jamb. This is obtained by appropriate positioning of the pivot bearing relative to the outer surface of the door assembly and the front jamb and results in improved authenticity of the turning motion of the door assembly on opening and the position of the opened door assembly.

Furthermore, it is specially desirable and advantageous if a slot extends along the length of the bearing cavity from the cavity to the front end of the door assembly, said slot being delimited by door assembly portions which are capable of resiliently yielding outwardly. If a tilting force is exerted onto the opened door assembly, this enables the pivot pin to snap out of the bearing cavity through the widening slot as the door assembly portions yield outwardly, whereby fracture of the pivot bearing is avoided.

Moreover, it is specially desirable and advantageous if the door assembly is composed of at least two laminations and the bearing cavity is formed between two juxtaposed door laminations. Making up the door assembly from two or more laminations not only affords many important features which enhance the authentic appearance of the vehicle, but also simplifies construction of the bearing cavity because moulding complexities are avoided.

It is further specially desirable and advantageous if the plain terminal end of the pivot pin is a tight fit in a socket provided in the door sill. This simple method of installing the pivot pin ensures an adequately firm seat of the pivot pin in the door sill.

Finally, it is specially desirable and advantageous if the pivot pin extends over more than half the height of the lower section of the door assembly. Such a length of the pivot pin and cooperating bearing cavity warrants improved guidance and strength.

BRIEF DESCRIPTION OF THE DRAWINGS

A preferred embodiment of the invention is illustrated in the accompanying drawing in which FIG. 1 is a side elevation of part of a model vehicle with a side door, FIG. 2 is an elevation of part of the doorway for the side door in FIG. 1, FIG. 3 is an elevation of part of a door assembly of the side door in FIG. 1, FIG. 4 is a section along the line IV—IV in FIG. 3 and FIG. 5 is an elevation of part of a door lamination of the door assembly in FIG. 3.

DETAILED DESCRIPTION OF THE PREFERRED EMBODIMENTS

The model vehicle shown in the drawing has wheels 2 under a body 1 and a front engine bonnet 3. The body 1 is formed with a roof 4 and at the front has a windscreen 5. On both sides of the model vehicle, there is a side door 6 of which only one is shown in the drawing. The side door 6 fits a doorway 7 delimited by a door sill 8, a front jamb 9 and other parts of the body 1. In the doorway 7 there is provided a door assembly 10 which comprises a window section 11 and a lower section 12. What cannot be seen from the drawing is that the window section 11 is raked inwardly from the lower section 12 since the horizontal cross-sectional area or width of the model vehicle decreases upwardly from the lower section of the door assembly which fact is important for the installation of the door assembly 10 on the body 1 described below.

The smooth terminal end of a pivot pin 14 which projects straight up is a tight fit in a socket 13 in the door sill 8, said socket being situated at a small, but distinct, distance from the front jamb 9. In its lower section 12, the door assembly 10 is formed with a bearing cavity 15 which is open at the bottom to receive the pivot pin 14 with a friction fit. The door assembly 10 is laminated in its lower section 12 with an outer lamination 16, a centre lamination 17 and an inner lamination 18. The centre lamination 17 is extended by the window section 11 with a window. The bearing cavity 15 is formed between the outer lamination 16 and the centre lamination 17 in a manner that two parallel beads 19 are provided on the outer lamination 16, said beads defining a groove which is covered by the centre lamination 17. The centre lamination 17 and the outer lamination 16 are spaced apart in the region between the bead 19 close to the front jamb and the front end of the door assembly 10 so that a slot exists through which the pivot pin 14 can slip out orthogonally to its longitudinal expanse from the door assembly as strip-shaped parts of the door assembly 20 yield outwardly. The door assembly 10 is truncated at its front end and with said truncated end and the bearing cavity 15 located there is placed on the pivot pin 14, the truncated end being initially applied to the pivot pin in the region which is cleared by the inwardly raked window region of the body.

I claim:

1. A model vehicle with a side door, comprising:

a body provided on a chassis, which body forms a roof area;

a plastic door assembly attached to the chassis by a vertical pivot bearing, said body having a door sill and a front jamb delimiting a doorway;

an oblong metallic pivot pin attached to the door sill close to the front jamb so as to project upwardly from the door sill into the doorway;

a bearing cavity receiving said pivot pin is formed by the door assembly itself, the roof area having a cross-section that is narrowed at the least of the door sill, compared to the chassis width; and a socket in the door sill, the pivot pin having a smooth terminal end that sits in the socket in a fitted manner so that said door is freely rotatable with respect to said pin, the bearing cavity of the door assembly being slid over the pivot pin.

2. A model vehicle as defined in claim 1, wherein a distance between the bearing cavity and an outer surface of the door assembly is substantially smaller than a distance between the bearing cavity and an inner surface of the door assembly.

3. A model vehicle as defined in claim 1, wherein a gap is formed between an outer surface of the door assembly and the front jamb when the door assembly is swung open 90°, the pivot pin and bearing cavity being positioned so that, when closed, the door assembly sits at the front jamb.

4. A model vehicle as defined in claim 1, wherein a slot extends along the length of the bearing cavity from said cavity toward a front end of the door assembly, said slot being delimited by flexibly yielding door assembly sections, the flexibly yielding door assembly sections being outwardly bendable so that the pivot pin is able to snap out of bearing cavity when a tilting force is applied to the door assembly.

5. A model vehicle as defined in claim 1, wherein the door assembly is composed of at least two laminations and the bearing cavity is formed between two juxtaposed laminations.

6. A model vehicle as defined in claim 1, wherein the door assembly consists of a lower section and an upper window section, the pivot pin extending over more than half the height of the lower section of the door assembly.

* * * * *